US005320406A

United States Patent [19]

North

[11] Patent Number: 5,320,406

[45] Date of Patent: Jun. 14, 1994

[54] COMBINATION CUP HOLDER AND ARM REST

[76] Inventor: Kevin A. North, 3822 Edinburgh St., Burnaby, B.C., Canada, V5C 1R6

[21] Appl. No.: 83,720

[22] Filed: Jun. 24, 1993

[51] Int. Cl.[5] ..... A47C 7/62

[52] U.S. Cl. ..... 297/194; 224/275; 248/118; 248/311.2

[58] Field of Search ..... 248/311.2, 146, 150, 248/313, 118; 224/42.43, 42.43 R, 275, 281, 282; 297/194, 188; 108/26

[56] References Cited

U.S. PATENT DOCUMENTS

| | | | |
|---|---|---|---|
| 3,356,409 | 12/1967 | Belsky | 224/275 X |
| 4,757,928 | 7/1988 | Browne | 224/275 |
| 4,795,211 | 1/1989 | Stern | 248/311.2 X |
| 4,798,413 | 1/1989 | Capelli | 297/194 |
| 4,844,394 | 7/1989 | Randolph | 248/311.2 X |
| 4,863,134 | 9/1989 | Young | 297/194 X |
| 5,054,726 | 10/1991 | Mattox | 248/311.2 |
| 5,232,190 | 8/1993 | Gould | 248/311.2 |
| 5,232,262 | 8/1993 | Tseng | 248/311.2 |
| 5,234,251 | 8/1993 | Ayotte | 297/194 |

*Primary Examiner*—J. Franklin Foss
*Attorney, Agent, or Firm*—Donna J. Thies

[57] ABSTRACT

A combination cup holder and arm rest for use in a rowed seating arrangement. The combination cup holder and arm rest includes an elongated arm rest member which has attachment means so that the arm rest member can be fixedly attached to the existing arm rest of a chair or the existing arm rest of the chair can be removed and the elongated arm rest member can be fixedly attached to the standard of an existing arm rest. A neck member connects the elongated arm rest member to a cup holder portion and the neck member fits between the backs of two chairs thereby facing the cup holder portion of the combination cup holder and arm rest rearwardly to be used by the person seated behind the chair that the combination cup holder and arm rest is attached to so as not to encroach on the leg room or front chair width of the user of the chair to which the combination cup holder and arm rest is attached. The neck member also angles the cup holder portion downwardly relative to the elongated arm rest member so that the cup holder portion fits within the predetermined angle between the perpendicular formed by the floor relative to the top of the seat back and the incline of the back of the chair relative to the horizontal and the cup holder portion does not intrude into aisle space in front of or behind a chair. A method of installing the combination cup holder and arm rest is also disclosed.

20 Claims, 8 Drawing Sheets

COMBINATION CUP HOLDER AND ARM REST

BACKGROUND OF THE INVENTION

In many rowed seating arrangements, such as in a theater or a stadium it has been determined to be desirable to provide a cup holder for the convenience of patrons such that they can enjoy refreshments during the entertainment without concern about holding on to a cup for long periods of time or spilling a drink by placing it on the floor. Previously cup holders have most often been positioned at the front end of the arm rest between two seats in the row. This presents several problems. With the cup holder positioned at the front of the arm rest, the cup holder is in close proximity to the patron's lap, and when a drink is spilled it usually spills in the patron's lap or onto the person seated next to him. Also, the proper use of the arm rest is uncertain. As it is uncertain which arm rest is to be used by which patron, it is also uncertain which cup holder should be used by each patron. Further, as some patrons are seated and others wish to come in or leave an aisle, the extension of an arm rest in the form of a cup holder Juts out into the aisle where people can bump into it or dislodge it from the arm rest. Another problem associated with a forward facing cup holder is that it encroaches into the seat width so that a patron wishing to cross his legs or the like will end up kicking or bumping the cup holder. Also, with a cup holder placed at about knee level next to the patron, the patron will not readily see the front or side portion of the cup holder thereby foregoing an opportunity to benefit from advertising indicia placed on the front or side surface of the cup holder.

In cases where a cup holder has been designed to be rear facing between the backs of two seats it has been attached directly to the back of the seat requiring a plastic to plastic connection which is easily broken off or separated and requiring much maintenance. Where the cup holder is attached to the side portion of the back of the chair, dismantling of the seat is required for attachment of the cup holder and then the chair must be put back together after the cup holder is installed, making this prior art method and apparatus extremely labor intensive.

U.S. Pat. No. 307,852 shows a drink cup holder which is attached by screws or the like directly to the rear facing back of a chair.

U.S. Pat. No. 311,105 shows a combination arm rest and cup holder which faces forward and has various annular rings for holding various size cups.

U.S. Pat. No. 328,223 shows a drink cup holder with an arm used for attaching the cup holder to the plastic side facing portion of a chair back.

U.S. Pat. No. 4,863,134 discloses a combination arm rest and cup holder which faces forward and has coaxial bores of different diameters for different size cups.

SUMMARY OF THE INVENTION

In order to overcome the problems hereinbefore described, there has been provided by the applicant's invention a new and novel combination cup holder and arm rest which comprises an elongated member positioned over the existing arm rest of a chair. Attachment means are provided for attaching the elongated member to the arm portion of a chair. The attachment means allows the elongated member of the present invention to be fixedly attached to an existing arm rest section of the arm portion of a chair or allows the elongated member to fixedly attached to the standard or support section of the arm portion of a chair. The elongated member is fixedly attached to a cup receiving member by an angling means which angles the cup receiving member downwardly relative to the elongated member. The angling means fits through the space between the backs of two adjacent chairs and thus faces the cup receiving member rearwardly to service a chair positioned behind the chair which has the elongated member attached to the arm portion. The cup holder portion of the present invention is designed to face rearwardly behind a chair and to angle downwardly within the slope of the back portion of the chair so as not to extend out into the aisle behind one row of chairs and in front of the next row of chairs.

It is therefore an object and advantage of the present invention to provide a combination cup holder and arm rest that is more convenient for the theater owner and the patron.

Another object and advantage of the present invention is to provide a combination cup holder and arm rest which is securely fastened to an existing arm portion of a chair. This provides safety for the theater patron and convenience and less maintenance expense for the theater owner.

A further object and advantage of the present invention is to provide a combination cup holder and arm rest which does not encroach on the available width of the seat portion of a chair.

Yet another object and advantage of the present invention is to provide a combination cup holder and arm rest which does not encroach on the aisle width available between rows of chairs.

Still yet another object and advantage of the present invention is to provide a combination cup holder and arm rest having a cup holder portion which easily conveys an advertising message.

Still yet another object and advantage of the present invention is to provide a combination cup holder and arm rest that is less labor intensive to install and maintain.

These and other objects and advantages will become apparent from a review of the drawings and from a study of the specification portion hereinafter describing the preferred embodiment of the invention.

BRIEF DESCRIPTION OF THE DRAWINGS

FIG. 5 shows a forward chair with the combination cup holder and arm rest attached to an existing arm rest and a rearward chair with the combination cup holder and arm rest attached to the standard or support section of the chair. FIG. 5 shows most clearly that the aisle space between the forward chair and the rearward chair is not encroached by a cup holder.

DESCRIPTION OF THE PREFERRED EMBODIMENT

Figure 1:
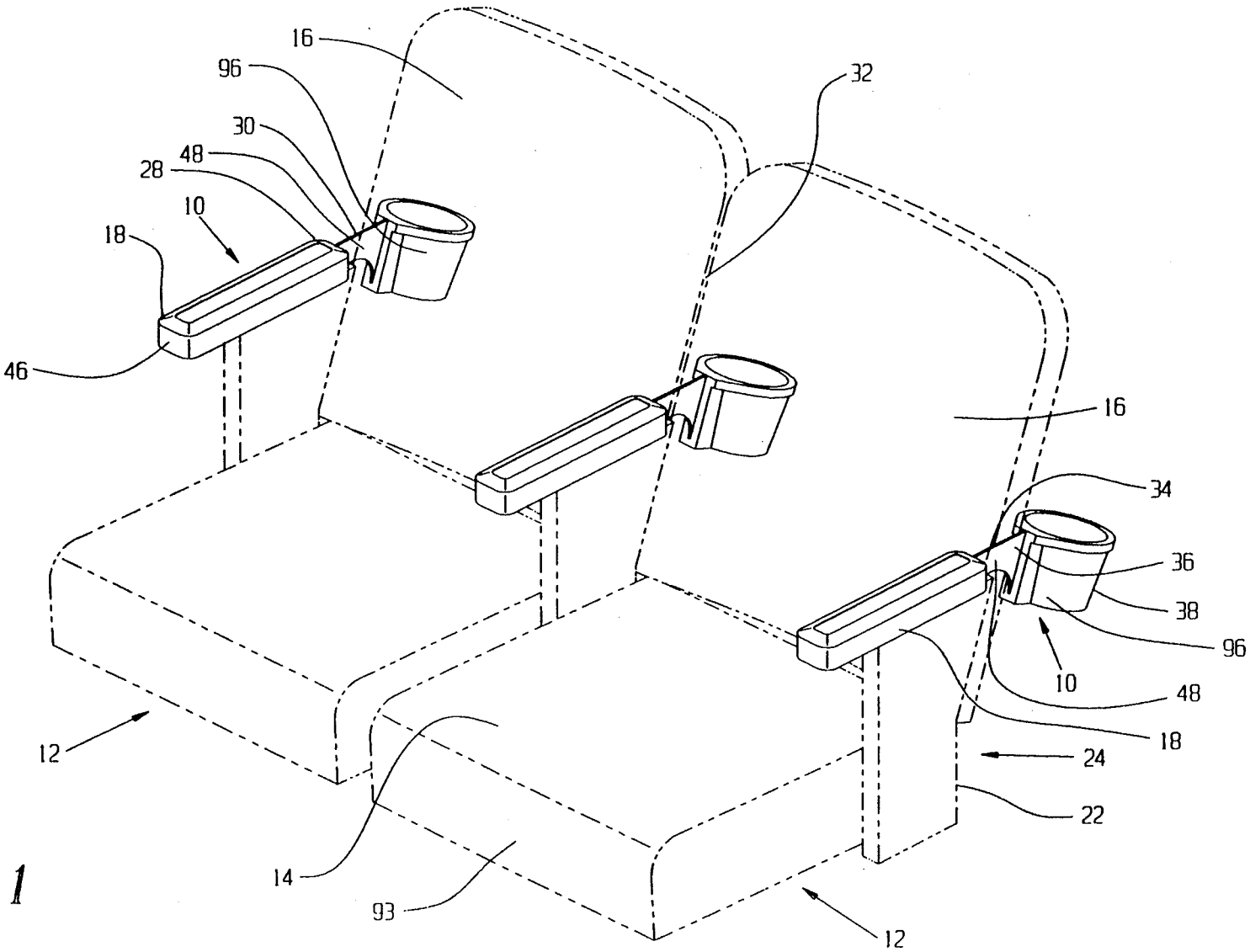
FIG. 1 is a perspective view of the present combination cup holder and arm rest as it is used in a typical rowed seating arrangement.

Referring now to the drawings in general and in particular to FIG. 1 of the drawings, there is shown a perspective view of the combination cup holder and arm rest shown generally by the numeral 10. The combination cup holder and arm rest 10 is shown as it is used in a typical seating arrangement with the chairs in phantom shown generally by the number 19., the chairs having a seat portion 14 and a back portion 16. It can been seen in FIG. 1 that the combination cup holder and arm rest 10 has a elongated member 18 which serves as the arm rest portion of the present invention. The elongated member 18 is fixedly attached either to the existing arm rest 20 of a chair 12 or to the standard 22 or support section of the arm portion 24 of a chair by means of attachment assembly means 26 as seen most clearly in FIGS. 7A and 7B. During the initial installation of the present combination cup holder and arm rest 10, the elongated member 18 is fixedly attached to the arm portion 24 of a chair 12. as will be described later in greater detail with reference to FIG. 4.

Fixedly attached to the rearward portion 28 of the elongated member 18 is an angling means 30. The angling means 30 in the present invention is also a connecting neck member and fits through the space 32. between the back portions 16 of two adjacent chairs 12. The front end 34 of the angling means 30 is thus fixedly attached to the rearward portion 28 of the elongated member 18. The rear end 36 of the angling means 30 is fixedly attached to the cup receiving member 38. In the preferred embodiment of the present invention, the angling means 30 serves to angle the cup receiving member 38 at substantially a 20 degree angle downwardly relative to the elongated member 18. It can be seen in FIG. 1 and more clearly in FIG. 5 that the angle of the cup receiving member 38 relative to the back 16 of the chair 12 should be 90 degrees or more. If, as in the example of FIG. 5 and as is the case in most theaters, the angle of the back 16 of the chair 12 relative to the seat 14 of the chair 12 is upward at a 110 degree angle there is formed a supplemental angle with the angle of the back 16 of the chair 12 relative to the horizontal thereby making the angle of the back 16 of the chair 12 relative to the horizontal substantially 70 degrees. The cup receiving member 38 should be angled downwardly relative to the elongated member 18 at substantially a 20 degree angle so as to allow the cup receiving member 38 to stay within the perpendicular formed by the floor and the top of the back 16 of the chair 12. The purpose of the downward angle of the cup receiving member 38 relative to the elongated member 18 is to ensure that the cup receiving member 38 will fit within the angle formed by the incline of the back portion 16 of the chair 12 relative to the perpendicular as it already exists in most theaters, this is shown most clearly in FIG. 5. In this way, the cup receiving member 38 does not intrude into the aisle space 40 between the forward row of chairs 42 and the rearward row of chairs 44 as seen most clearly in FIG. 5. The angling of the cup receiving member 38 relative to the elongated member 18 also presents a convenient angle for the patron in the rearward row of chairs 44 in FIG. 5 to insert or remove a cup from the cup receiving member 38 without hitting the back 16 of the chair 12. This avoids a clumsy or stiff straight up and down movement of the user's arm required with a cup holder positioned at the front end 46 of an arm rest 20 as required in the prior art and seen most clearly in FIG. 6. While in the preferred embodiment of the present invention a downwardly 20 degree angle of the cup receiving member 38 relative to the elongated member 18 is affected, it is to be understood that this is illustrative and that different angling of the cup receiving member 38 relative to the elongated member 18 is within the spirit and scope of the invention.

Figure 2:
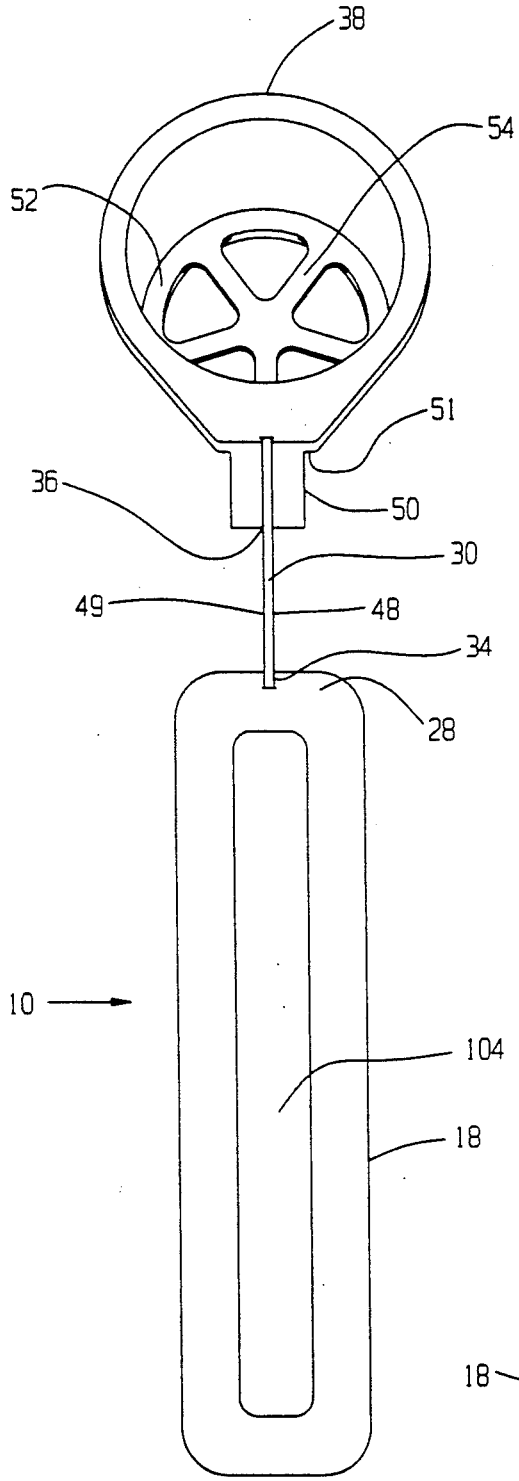
FIG. 2 is a top plan view of the preferred embodiment of the present combination cup holder and arm rest.

Referring now to FIG. 2 of the drawings there is shown a top plan view of the preferred embodiment of the present invention. In FIG. 2 it can been seen that the angling means 30 connects the elongated member 18 to the cup receiving member 38. In the preferred embodiment of the present invention, the front end 34 of the angling means 30 is encased within the rearward portion 28 of the elongated member 18. In this way, the sides 48 and 49 of the narrow angling means 30 are protected and the front end 34 of the angling means 30 is securely and fixedly attached to the rearward portion 28 of the elongated member 18. In a like manner, the rear end 36 of the angling means 30 is encased within the supporting receptacle 50 that is integral with the rear facing portion 51 of the cup receiving member 38, similarly protecting the sides 48 and 49 of the narrow angling means 30 and ensuring that the rear end 36 of the angling means 30 is securely and fixedly attached to the cup receiving member 38. The supporting receptacle 50 thereby ensures the stability and firm attachment of the angling means 30 to the cup receiving member 38. In FIG. 2 it is seen that the bottom 52 of the cup receiving member 38 is a hub 54 for securely holding the bottom of a cup. Since this hub 54 serves to secure the bottom of a cup, a large variety of cup sizes are serviced without concern for providing various size annular rings or the like to receive various sized top lips of cups as required in the prior art.

Figure 3:
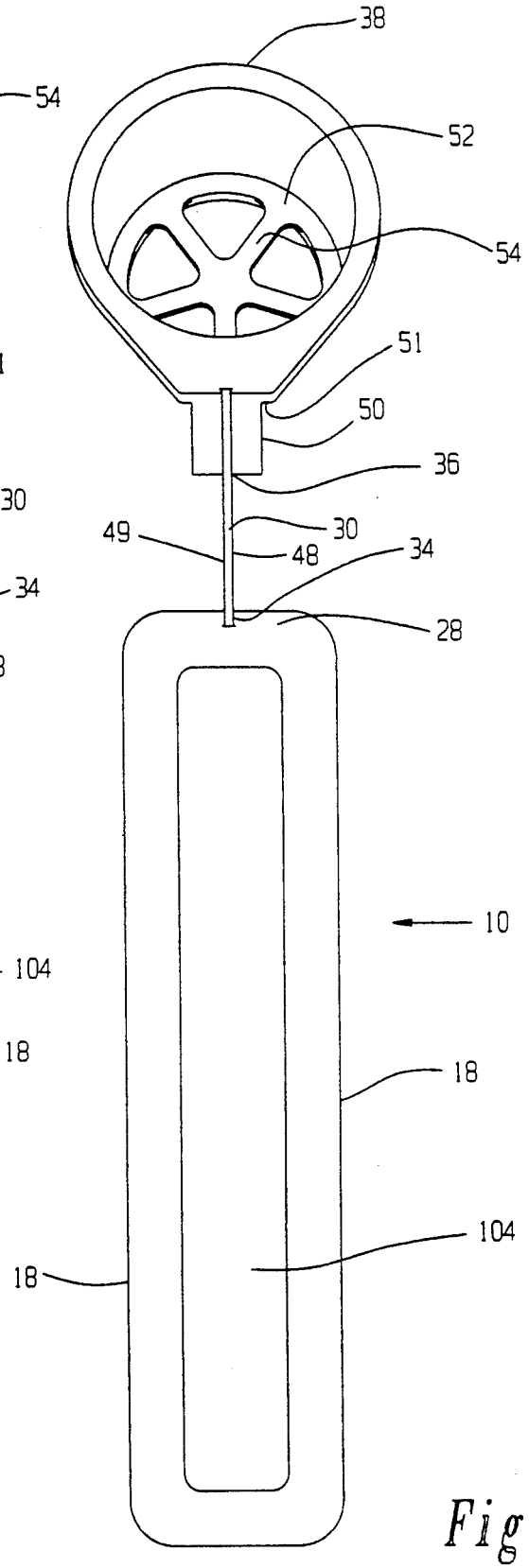
FIG. 3 is a top plan view of an alternate embodiment of the present invention showing an alternate arm rest portion to accommodate an existing arm rest having alternate dimensions.

FIG. 3 is a top plan view of an alternate embodiment of the present invention. In adapting the present combination cup holder and arm rest 10 for use in rows of theater chairs or the like the elongated member 18 functions as the arm rest portion of the present invention. When the combination cup holder and arm rest 10 is installed, the elongated member 18 or arm rest portion of the present invention is adapted to fit over and cover the existing arm rest 20 of the chair 12 as seen most clearly in FIG. 7A. Most theater seat arm rests conform to the dimensions as used in the preferred embodiment of FIG. 9.. FIG. 3 is illustrative of the elongated member 18 of the present invention being adapted to fit a chair arm rest of alternate dimensions. FIG. 3 is to be understood to be only illustrative of an alternate dimension chair arm rest which would be accommodated by the present invention, however the present invention is by no means to be limited to the specific dimensions as shown and described.

Figure 4:
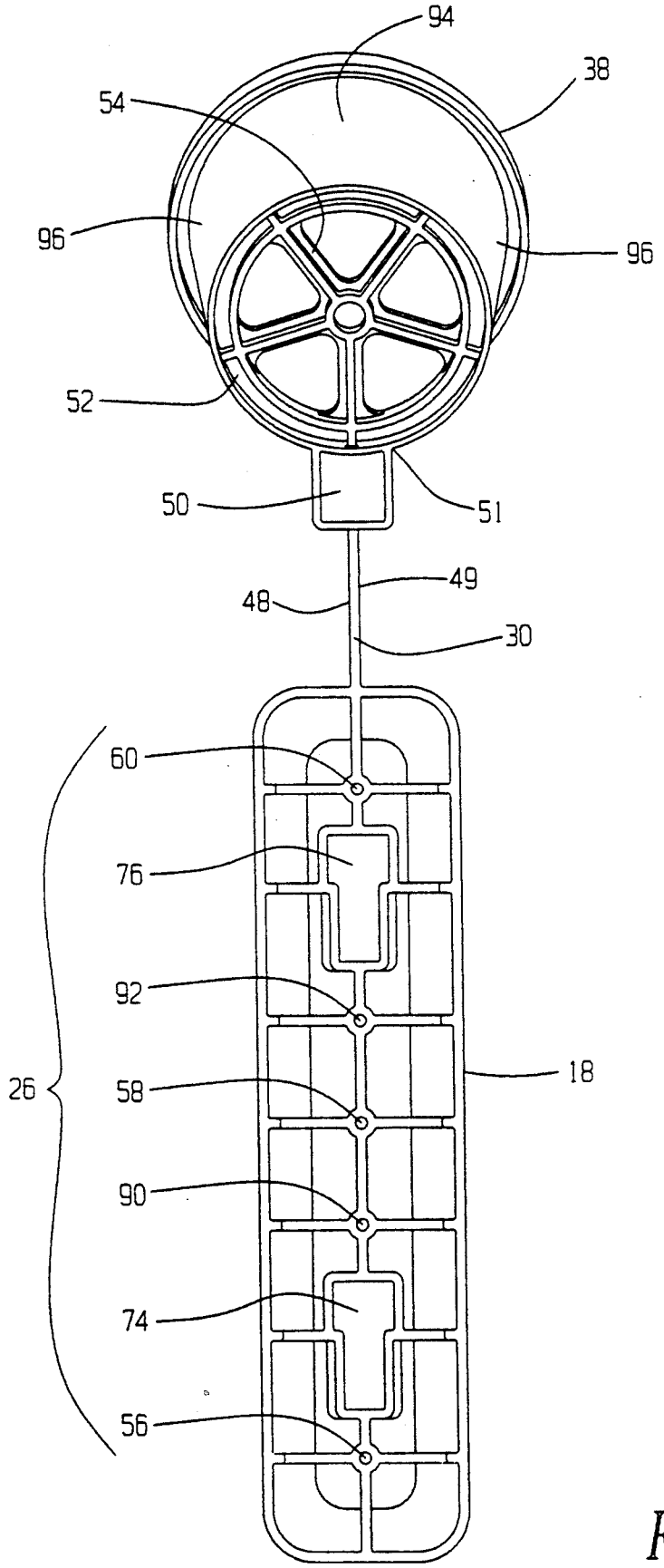
FIG. 4 is a bottom plan view of the present combination cup holder and arm rest showing most clearly the attachment means of the present invention.
Figure 7A:
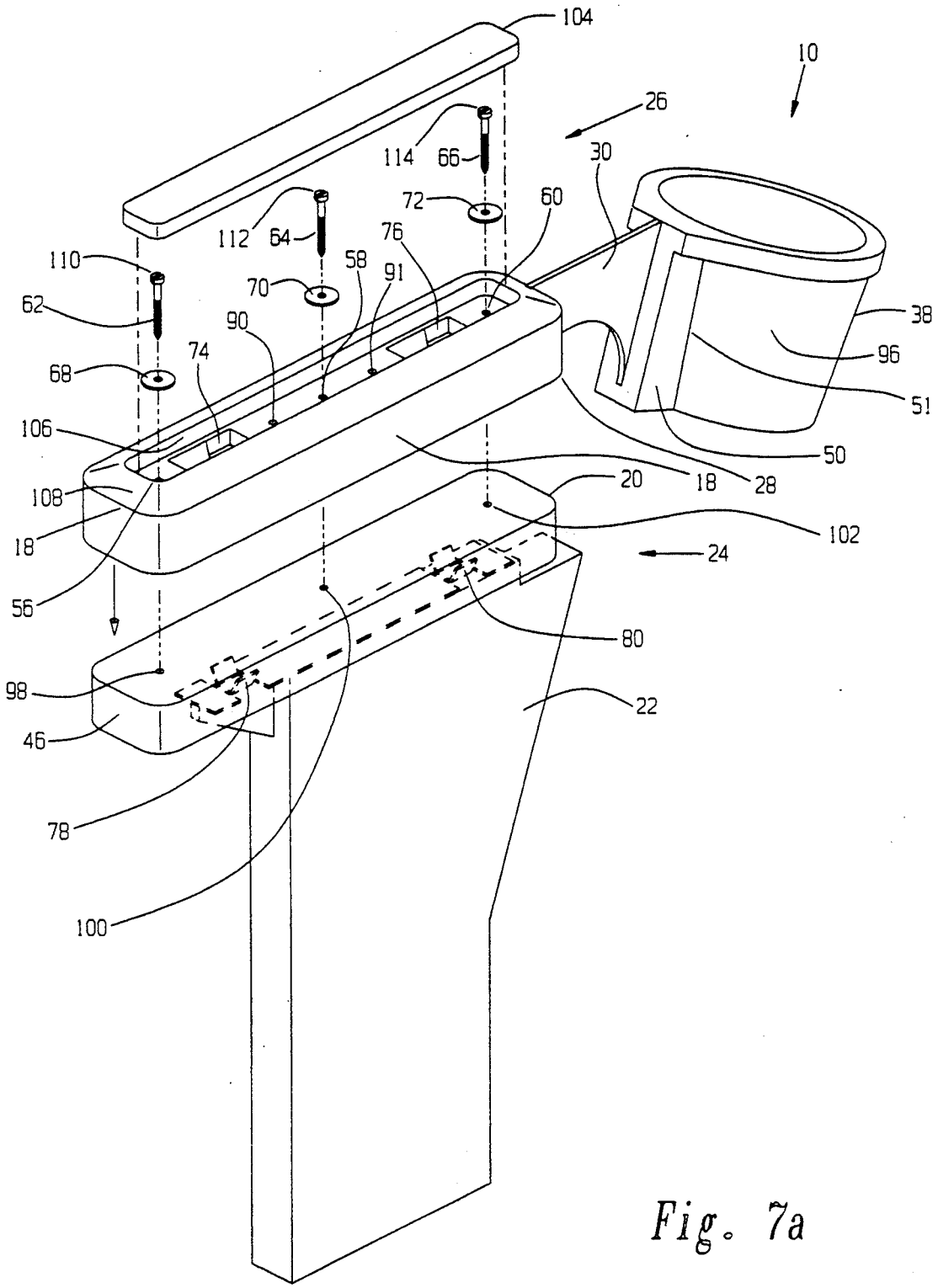
FIG. 7A is an exploded perspective view of the preferred embodiment of the present invention showing how the combination cup holder and arm rest is positioned over the existing arm rest of a chair in a seating arrangement.
Figure 7B:
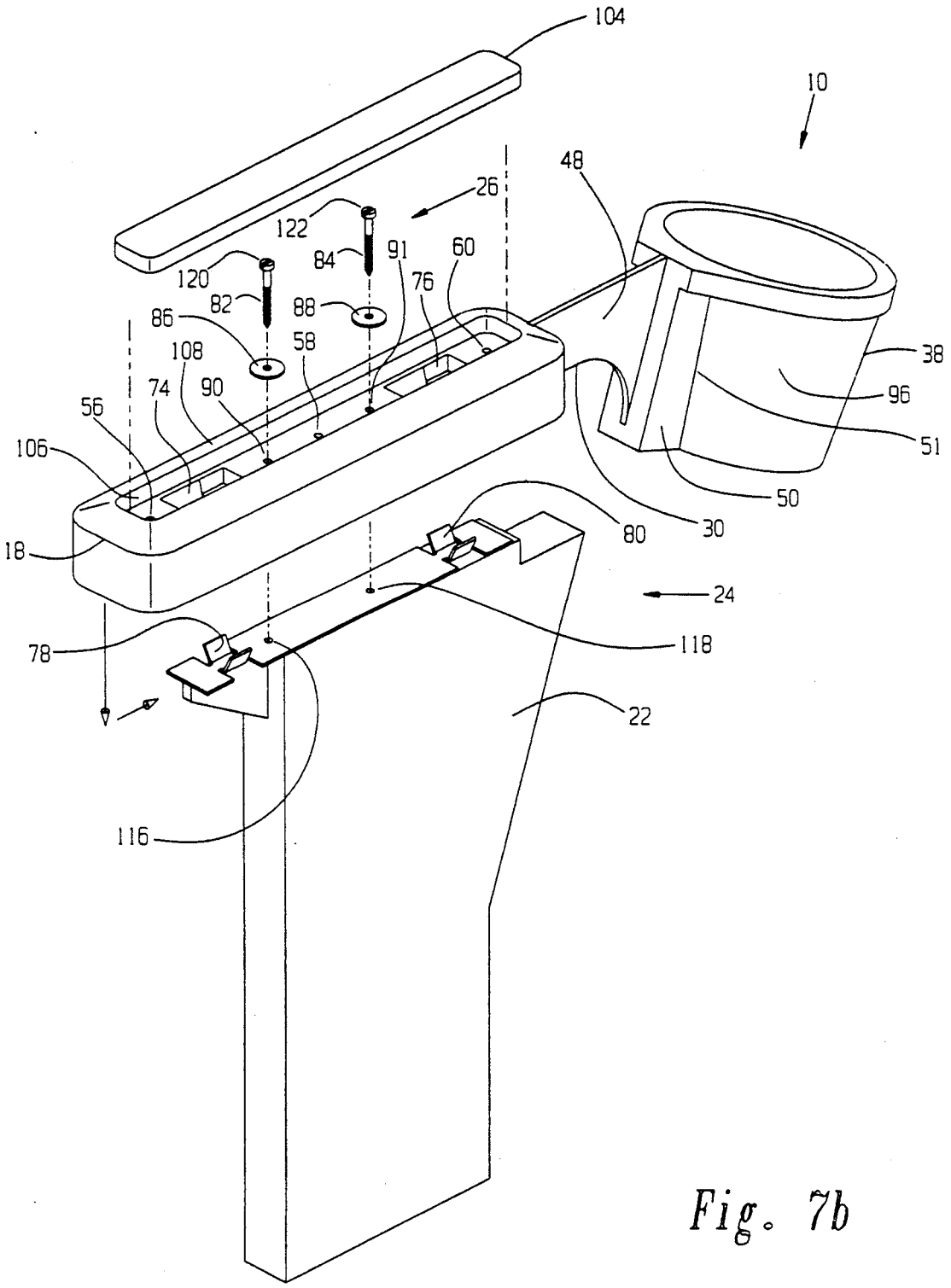
FIG. 7B is an exploded perspective view of the preferred embodiment of the present invention with the existing arm rest of the chair removed and showing how the combination cup holder and arm rest of the present invention is positioned over and secured directly to the standard or support section of the arm portion of a chair.

Referring now to FIG. 4 of the drawings there is shown a bottom plan view of the present new and novel combination cup holder and arm rest. In the bottom plan view of FIG. 4 the hubbed bottom portion 52 of the cup receiving member 38 as described with reference to FIG. 2 can be seen. In FIG. 4 and FIGS. 7A and 7B the attachment assembly means 26 of the present invention is most clearly shown. In the preferred embodiment of the present invention, the attachment assembly means 9.6 includes the means for attaching the elongated member 18 to the existing arm rest 20 and means for attaching the elongated member 18 to the standard 22 or support section of the arm portion 24 of the chair 12 as seen most clearly in FIGS. 5, 7A, and 7B. In the preferred embodiment, this is accomplished simply by positioning the wood screws 62, 64, and 66 through corresponding washers 68, 70, and 72 and then into the corresponding holes 56, 58, and 60 in the attachment assembly means 26 and into the existing arm rest 20 of a chair 12 as seen most clearly in FIG. 7A. Since the existing arm rest 20 of the chair 12 is most often wood, a tight wood screw connection is accomplished thereby securing the elongated member 18 to the existing arm rest 20 of a chair 12 without concern for the cracking of plastic or the inadvertent dislocation of the attachment assembly means 26, or elongated member 18 from the arm rest 20 of the chair 12 as seen in FIG. 5.

It can therefore be seen that over the existing wooden arm rest 20 of the chair 12 has been attached the plastic elongated member 18 or arm rest portion of the present invention as seen most clearly in FIG. 7A. In this way, the patron's arm rest is now plastic providing a more comfortable surface for resting an arm and the elongated member 18 of the present invention is ergonomically designed having a smooth surface and rounded edges. The attachment assembly means 26 includes the holes 56, 58, and 60 which carry the screws 62, 64, and 66, the screws 62, 64, and 66 having corresponding washers 68, 70, and 72 (as seen in FIG. 7A) for attaching the elongated member 18 securely to the existing arm rest 20 of a chair 12.

Figure 5:
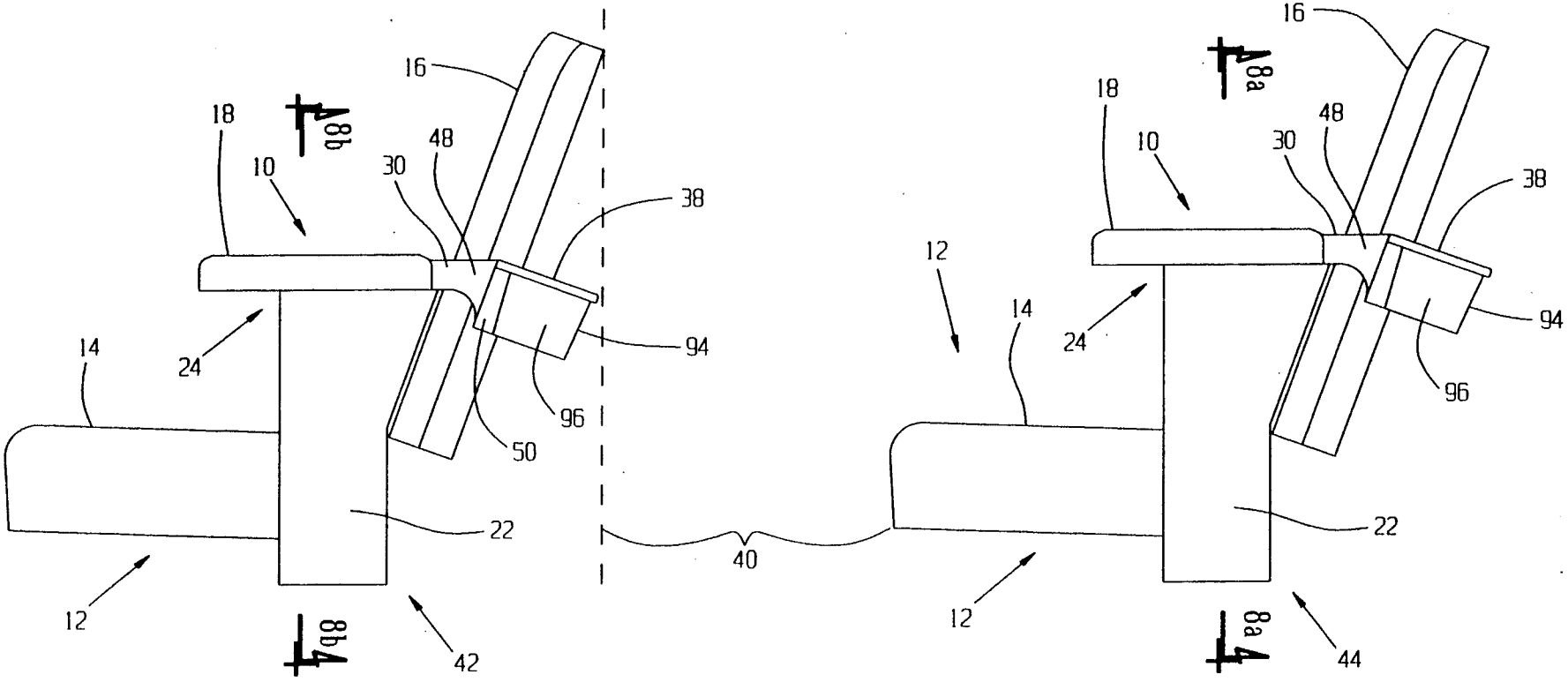
FIG. 5 is a side elevational view of the present invention as it is positioned on a chair in a typical rowed seating arrangement.

If at the time of installation of the present combination cup holder and arm rest, it is determined to be preferable to remove the existing arm rest 20 and attach the elongated member 18 directly to the standard 22 or support section of the arm portion 24 a second mode of attachment can be employed as shown in FIG. 7B whereby the key hole openings 74 and 76 are engaged over the winged tabs 78 and 80 on the standard 22 and the winged tabs 78 and 80 on the standard 22 are snapped into the key hole openings 74 and 76 thereby securing the elongated member 18 directly to the standard 22 or the arm portion 24 of the chair 12 as seen also in the rearward chair 44 of FIG. 5. There are numerous reasons why the installer of the present invention may wish to remove the existing arm rest 20 and install the elongated member 18 directly onto the standard 22 of the arm portion 24. One of these reasons may be that the existing arm rest 20 is in poor repair or fabric covered so as to preclude the installation of the present invention onto the arm rest section of the arm portion 24 of a chair 12. When the installer chooses to attach the elongated member 18 directly to the standard 22 or support section of the arm portion 24, screws 82 and 84 are positioned through corresponding washers 86 and 88 and then positioned through the screw hole openings 90 and 92, as seen in FIG. 7B. In the preferred embodiment, the attachment means also includes the key hole openings 74 and 76, wing tabs 78 and 80, screws 82 and 84, washers 86 and 88, and screw hole openings 90 and 92 used for the alternate installation of the elongated member 18 onto the standard 22 or support section of the arm portion 24 as shown in FIG. 7B. The screws 82 and 84 and the corresponding washers 86 and 88 are used to allow adjustment in securely attaching the elongated member 18 to the standard 22 and are also used for adjustment of the cup receiving member 38 relative to the elongated member 18 and the back 16 of the chair 12. The screws 82 and 84 positioned through the screw hole openings 90 and 92 allow about a one half inch adjustment in the lateral movement of the elongated member 18. This lateral adjustment in the attachment assembly means 26 allows flexibility in the positioning of the cup receiving member 38 relative to the elongated member 18 and the back 16 of the chair 12. Thus, if at the time of installation it is desired to move the cup receiving member 38 closer to or further from the incline of the back 16 of the chair 12 this can be accomplished by adjusting the lateral movement of the elongated member 18 thereby insuring that the cup receiving member 38 will be positioned within the space behind the incline of the back 16 of the chair and not protrude out into the aisle 40 behind the chair, as seen most clearly in FIG. 5.

In FIG. 5 of the drawings there is shown a side elevational view of two of the present combinations cup holder and arm rest positioned on two arm portions of chairs. For purposes of illustration, the forward chair 42 representing the forward row of chairs in FIG. 5 carries the preferred embodiment of the present combination cup holder and arm rest 10 shown attached directly to an existing arm rest 20 section of the arm portion 24 of a chair 12 as shown also in FIG. 7A. The rearward chair 44 representing the rearward row of chairs in FIG. 5 carries the preferred embodiment of the present combination cup holder and arm rest 10 as it would be installed using the alternate method of installation as described with reference to FIG. 4 and as shown also in FIG. 7B. On the rearward chair 44 of FIG. 5 the existing arm rest 20 has been removed and the combination cup holder and arm rest 10 is attached to the support section or standard 22 of the arm portion 24 of the chair 12. Also in FIG. 5 it can be seen that the angling means 30 serves to angle the cup receiving member 38 of the present invention downwardly relative to the elongated member 18 such that the cup receiving member 38 remains within the angle of the back portion 16 of the chair 12 relative to the perpendicular formed by the floor and the top of the back 16 of the chair 12 and does not intrude into the aisle space 40 between the forward chair 42 and rearward chair 44.

Figure 6:
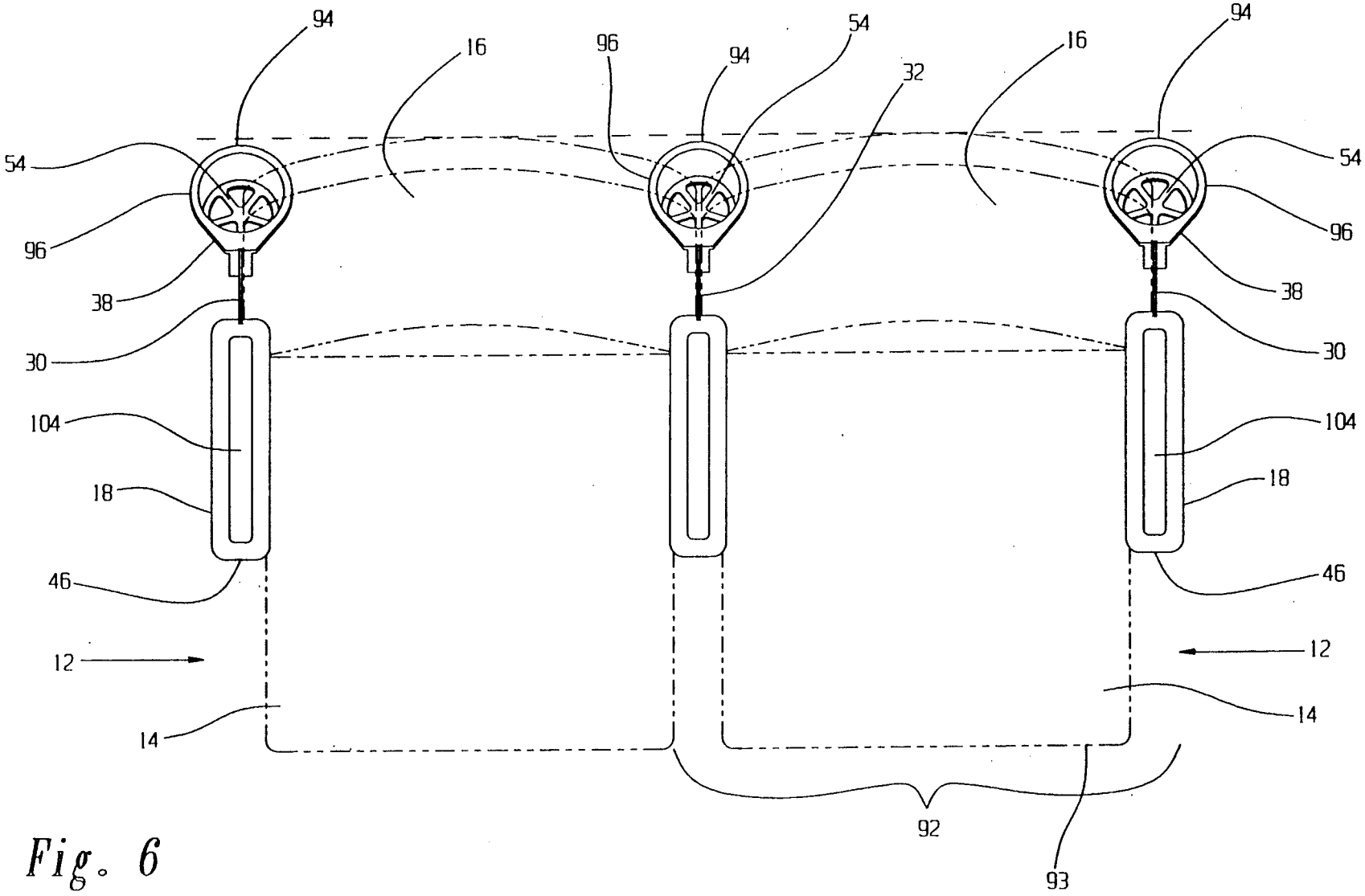
FIG. 6 is a top plan view of three of the present inventions as used in a typical seating arrangement with two chairs shown in phantom.

In FIG. 6 there is shown a top plan view of three of the present combinations cup holder and arm rest as they are positioned in a typical rowed seating arrangement. In FIG. 6 it becomes apparent that the leg room 92 across the front portion 93 of the seat 14 of the chair 12 is not encroached by cup holders positioned at the front end 46 of the arm rest 20 as in the prior art. The cup receiving member 38 is rearwardly facing toward the row of seats 44 behind the chair arm portion 24 that the elongated member 18 is attached to as seen in FIG. 5. Since the cup receiving member 38 is positioned substantially at arm's height and reach of a person sitting behind it, it becomes clear in FIG. 5 and FIG. 6 that the front facing portion 94 and broadest surface of the cup receiving member 38 is clearly visible to the patron behind it. Therefore, if advertising indicia is placed on the front facing 94 and/or side facing 96 surfaces of the cup receiving member 38 the advertisement will be clearly visible at all times to the person using the cup holder and to those on either side of the user. When the theater owner rents this advertising space the cost of installation of the cup holders is offset and future revenues are provided, making the present invention extremely economical in use.

Referring now to FIG. 7A of the drawings there is shown an exploded perspective view of the preferred embodiment of the present invention showing how the elongated member 18 of the present combination cup holder and arm rest 10 is fixedly attached to the existing arm rest 20 of a chair 12. In the preferred embodiment as shown in FIG. 7A and the forward chair 42 in FIG. 5, the elongated member 18 is positioned over the existing wooden arm rest 20 of a chair 12. The three holes 56, 58, and 60 in the elongated member 18 serve as securing points in positioning the elongated member 18 onto the existing arm rest 20 of the arm portion 24. Upon installation of the present invention the screws 62, 64, and 66 are positioned through the washers 68, 70, and 72 and then through the holes 56, 58, and 60 of the attachment assembly means 26 on the elongated member 18 and driven into the existing wooden arm rest 20 at three corresponding locations 98, 100, and 102. In this way, the elongated member 18 is securely and fixedly attached to the existing arm rest 20 of the arm portion 24 of the chair 12 as shown also in the forward chair 42 in FIG. 5. The plate 104 is then snapped into the corresponding and receiving opening 106 in the top surface 108 of the elongated member 18. The plate 104 serves as a decorative cover over the exposed screw heads 110, 112, and 114 and also functions to make the top surface 108 of the elongated member 18 a smooth surface that is comfortable when used as an arm rest by a patron as described with reference to FIG. 4.

In FIG. 7B of the drawings there is shown an exploded perspective view of the preferred embodiment of the present invention showing the second mode of installation whereby the elongated member 18 of the present combination cup holder and arm rest 10 is fixedly attached to the support section or standard 22 of the arm portion 24 of a chair 12 as described with reference to FIG. 4 and shown on the rearward chair 44 of FIG. 5. In FIG. 7B the existing arm rest 20 of a chair 12 has been removed, as clearly seen when comparing FIG. 7A to 7B. In FIG. 7B the elongated member 18 of the present invention is secured directly to the standard 22 or support section of the arm portion 24 of the chair 12. The key hole openings 74 and 76 of the attachment assembly means 26 on the elongated member 18 are positioned over the winged tabs 78 and 80 on the standard 22 and the winged tabs 78 and 80 are locked into the key hole openings 74 and 76. The screws 82 and 84 that are positioned through the washers 86 and 88 and through the screw holes 90 and 91 of the attachment assembly means 26 on the elongated member 18 and screwed into corresponding locations 116 and 118 on the standard 22 serve to allow adjustment of the positioning of the cup receiving member 38 relative to the elongated member 18 and the back 16 of the chair 12 as described with reference to FIG. 4. In the second installation as shown in FIG. 7B the plate 104 is also snapped into the corresponding and receiving opening 106 in the top surface 108 of the elongated member 18. In the example of FIG. 7B the plate 104 serves as a decorative cover over the exposed screw heads 120 and 122 of the screws 82 and 84 and also functions to make the top surface 108 of the elongated member 18 a smooth, comfortable surface when used as an arm rest by a patron as described with reference to FIGS. 4 and 7A.

Figure 8B:
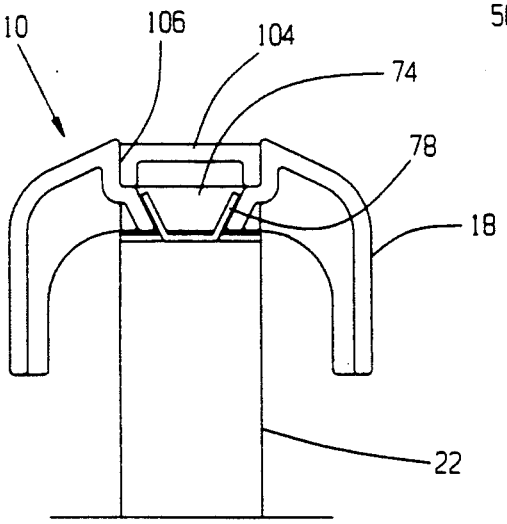
FIG. 8B is a cross-sectional view taken through line 8B—8B of FIG. 5 of the present combination cup holder and arm rest with the existing arm rest removed and without any arm rest except as provided by the present combination and showing the combination as it is positioned over and secured directly to the standard or support section of the arm portion of a chair.
Figure 8A:
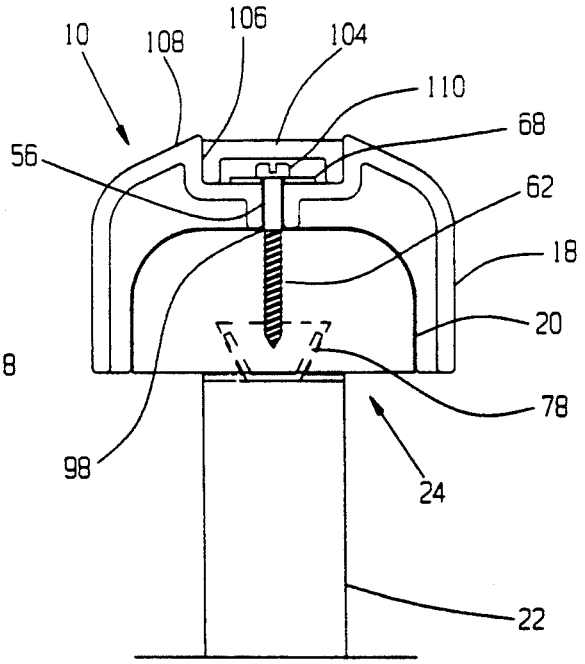
FIG. 8A is a cross-sectional view taken through line 8A—8A of FIG. 5 of the present combination cup holder and arm rest as it is positioned over an existing arm rest of a chair.

Referring now to FIG. 8A there is shown a cross-sectional view taken through line 8A—8A of FIG. 5 showing the preferred embodiment of the present invention as it is positioned over an existing arm rest 20 of a chair 12 as seen also on the forward chair 42 of FIG. 5. In FIG. 8A there is seen the decorative cover plate 104 positioned over the opening 106 in the top surface 108 of the elongated member 18. The screw 62 is secured through the washer 68 to ensure a tight attachment of the elongated member 18 to the existing arm rest 20 of a chair 12. The screw 62 is further positioned through the hole 56 of the attachment assembly means 26 on the elongated member 18 and screwed into the corresponding location 98 on the existing arm rest 20 of a chair 12 as seen also in FIG. 7A.

In FIG. 8B there is shown a cross-sectional view taken through line 8B—8B of FIG. 5 of the present cup holder and arm rest 10 as it is positioned over and secured directly to the standard 22 or support section of the arm portion 24 of a chair 12 as shown also on the rearward chair 44 of FIG. 5. In FIG. 8B the second mode of installation has been employed as described with reference to FIG. 4 and FIG. 7B. In FIG. 8B the existing arm rest 20 of a chair 12 has been removed and the key hole opening 74 of the attachment assembly means 26 on the elongated member 18 is positioned over the winged tab 78 on the support section or standard 22 of the arm portion 24 and the winged tab 78 is locked into place within the key hole opening 74 as seen also in FIG. 7B.

Figure 9:
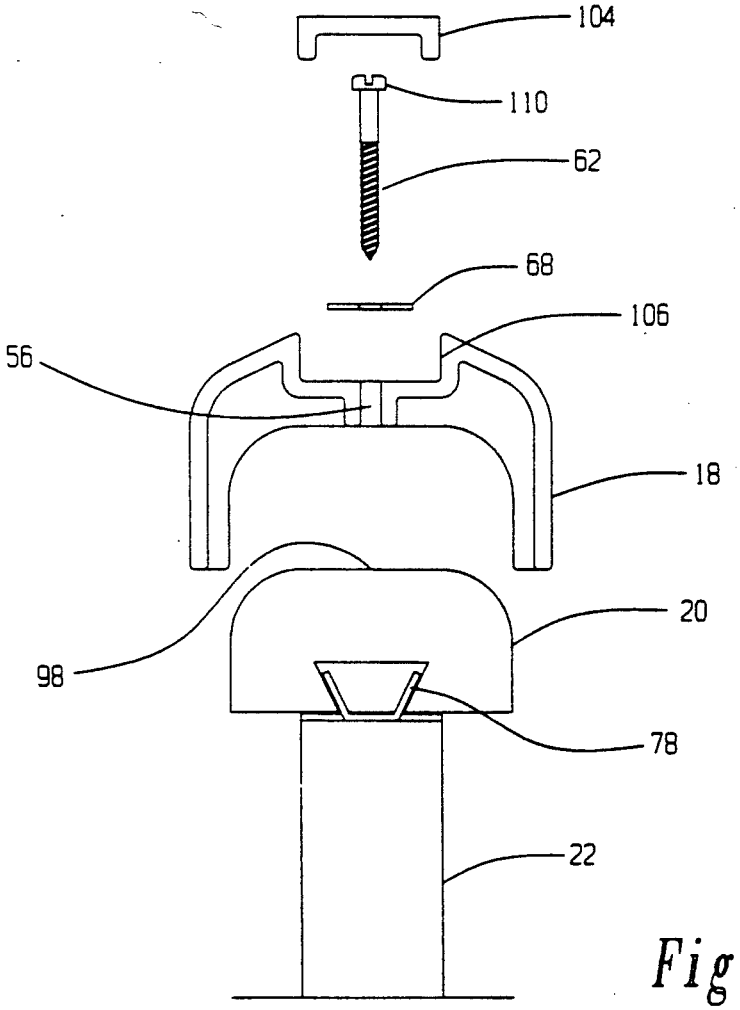
FIG. 9 is an exploded front view showing how the present combination cup holder and arm rest is positioned over and secured to an existing arm rest.

FIG. 9 is an exploded front view showing how the present combination cup holder and arm rest is positioned over and secured to an existing arm rest. In FIG. 9 the decorative plate 104 is positioned over the screw head 110, washer 68, and the receiving opening 106 in the elongated member 18. In installation, the screw 62 goes through the washer 68, and through the screw hole 56 of the attachment assembly means 26 on the elongated member 18 and into the corresponding location 98 on the existing arm rest 20 as seen also in FIG. 7A. In FIG. 9, the winged tab 78 on the standard 22 is shown as it normally engages the existing arm rest 20. In the second mode of installation as described with reference to FIG. 4 and FIG. 7B, the existing arm rest 20 is removed from the standard 22 and the winged tabs 78 and 80 on the standard 22 remain. After removal of the existing arm rest 20 the elongated member 18 is slid horizontally across the winged tabs 78 and 80 on the standard 22 and the winged tabs 78 and 80 are then engaged with the key hole openings 74 and 76 of the attachment assembly means 26 on the elongated member 18 of the present invention seen most clearly in FIG. 7B.

From the foregoing, it can be seen that the applicant's invention provides a combination cup holder and arm rest that does not encroach into the front chair's seat width or leg room nor into the aisle space behind the chair. There has been accomplished by the applicant's invention all of the objects and advantages of the invention. Nevertheless, variation in the structure of the invention and the arrangement of the various parts are within the spirit and scope of applicant's invention. The embodiments given have been given only by way of illustration and the applicant is not to be limited to the embodiments shown and described.

Having described my invention, I claim:

1. A combination cup holder and arm rest for holding a cup, the cup having a bottom surface, the combination cup holder and rest for use in a rowed seating arrangement, the seating arrangement having chairs, each chair having a seat portion and a back portion, the back portions having a space therebetween, each back portion being inclined relative to a horizontal seat portion at a predetermined angle, the chairs further having an arm portion between seat portions, the arm portion having an arm rest section and a support section, the combination cup holder and arm rest comprising;

a) an elongated member having a front and rear end;

b) attachment means positioned on the elongated member for fixedly attaching the elongated member to the arm portion of a chair;

c) a connecting neck member having a first and second end, the first end of the connecting neck member being attached to the rear end of the elongated member;

d) a cup receiving member attached to the second end of the connecting neck member, the cup receiving member having a bottom; and whereby the connecting neck member is positioned through the space between two back portions of two chairs thereby facing the cup receiving member rearwardly behind the space between the backs of two chairs.

2. The combination cup holder and arm rest as defined in claim 1 wherein:

c) the connecting neck member angles the cup receiving member downwardly relative to the elongated member at substantially a complementary angle to the angle formed by the back portion of the chair relative to the horizontal.

3. The combination cup holder and arm rest as defined in claim 1 wherein:

d) the cup receiving member contains advertising indicia.

4. The combination cup holder and arm rest as defined in claim 1 wherein:

b) the attachment means fixedly attaches the elongated member to the arm rest section of the arm portion of a chair.

5. The combination cup holder and arm rest as defined in claim 1 wherein:

b) the attachment means fixedly attaches the elongated member to the support section of the arm portion of a chair.

6. The combination cup holder and arm rest as defined in claim 1 wherein:

b) the attachment means comprises means for fixedly attaching the elongated member to the arm rest section of the arm portion of a chair and means for fixedly attaching the elongated member to the support section of the arm portion of a chair.

7. The combination cup holder and arm rest as defined in claim 6 wherein:

b) the attachment means comprises;

i) a plurality of first fasteners for fixedly attaching the elongated member to the arm rest section of the arm portion of a chair; and ii) a plurality of second fasteners for adjustment in fixedly attaching the elongated member to the support section of the arm portion of a chair and a plurality of openings in the elongated member for receiving tabs on the support section of the arm portion, whereby, the tabs fit into the openings and fixedly attach the elongated member to the support section of the arm portion.

8. The combination cup bolder and arm rest as defined in claim 1 wherein:

d) the bottom of the cup receiving member is substantially a hub arrangement for receiving the bottom surface of a cup to thereby hold a variety of cup sizes.

9. A combination cup holder and arm rest for use in a rowed seating arrangement, the seating arrangement having chairs, each chair having a seat portion and a back portion, the back portions having a space therebetween, each back portion being inclined relative to a horizontal at a predetermined angle, the chairs further having an arm portion between seat portions, the arm portion having an arm rest section and a support section, the combination cup holder and arm rest comprising:

a) an elongated member;

b) attachment means positioned on the elongated member for fixedly attaching the elongated member to the arm portion of a chair;

c) angling means having two ends fixedly attached at one end to the elongated member, the angling means being positioned through the space between the back portions of two chairs;

d) a cup receiving member attached to the second end of the angling means; and whereby the cup receiving member faces rearwardly behind the space between two back portions of two chairs.

10. The combination cup holder and arm rest as defined in claim 9 wherein:

d) the angling means angles the cup receiving member downwardly relative to the elongated member at substantially a complementary angle to the angle formed by the back portion of the chair relative to the horizontal.

11. The combination cup holder and arm rest as defined in claim 9 wherein:

c) the cup receiving member contains. advertising indicia.

12. The combination cup holder and arm rest as defined in claim 9 wherein:

b) the attachment means fixedly attaches the elongated member to the arm rest section of the arm portion of a chair.

13. The combination cup holder and arm rest as defined in claim 9 wherein:

b) the attachment means fixedly attaches the elongated member to the support section of the arm portion of a chair.

14. The combination cup holder and arm rest as defined in claim 9 wherein:

b) the attachment means comprises means for fixedly attaching the elongated member to the arm rest section of the arm portion of a chair and means for fixedly attaching the elongated member to the support section of the arm portion of a chair.

15. The combination cup holder and arm rest as defined in claim 14 wherein:

b) the attachment means comprises:

i) a plurality of first fasteners for fixedly attaching the elongated member to the arm rest section of the arm portion of a chair; and ii) a plurality of second fasteners for adjustment in fixedly attaching the elongated member to the support section of the arm portion of a chair and a plurality of openings in the elongated member for receiving tabs on the support section of the arm portion, whereby, the tabs fit into the openings and fixedly attach the elongated member to the support section of the arm portion.

16. A method of installing a combination cup holder and arm rest onto a chair in a rowed seating arrangement, each chair in the seating arrangement having a seat portion and a back portion, the back portions having a space therebetween, each back portion being inclined relative to a horizontal at a predetermined angle, the chairs further having an arm portion between seat portions, the arm portion having an arm rest section and a support section, the method comprising:

a) providing an elongated member having a front and rear end;

b) providing attachment means positioned on the elongated member;

c) fixedly attaching the elongated member to the arm portion of a chair using the attachment means;

d) providing a connecting neck member having a first and second end, the first end of the connecting neck member being attached to the rear end of the elongated member;

e) providing a cup receiving member attached to the second end of the connecting neck member;

f) positioning the connecting neck member through the space between two back portions of two chairs thereby facing the cup receiving member rearwardly behind the space between the backs of two chairs.

17. The method as defined in claim 16, wherein the elongated member is fixedly attached to the arm rest section of the arm portion of a chair.

18. The method as defined in claim 16, wherein the elongated member is fixedly attached to the support section of the arm portion of a chair.

19. The method as defined in claim 16, wherein:

b) the attachment means comprises means for fixedly attaching the elongated member to the arm rest section of the arm portion of a chair and means for fixedly attaching the elongated member to the support section of the arm portion of a chair.

20. The method as defined in claim 16, wherein:

d) the connecting neck member comprises angling means for angling the cup receiving member downwardly relative to the elongated member.

* * * * *